United States Patent [19]

Ecabert

[11] Patent Number: 4,742,668

[45] Date of Patent: May 10, 1988

[54] CIGARETTE CHECKING DEVICE AND PACKAGING APPARATUS

[75] Inventor: Philippe Ecabert, Montignez, Switzerland

[73] Assignee: F. J. Burrus SA, Switzerland

[21] Appl. No.: 907,313

[22] Filed: Sep. 15, 1986

[30] Foreign Application Priority Data

Sep. 24, 1985 [CH] Switzerland ..... 4129/85

[51] Int. Cl.[4] ..... B65G 57/09

[52] U.S. Cl. ..... 53/494; 53/149; 53/498; 356/445

[58] Field of Search ..... 53/494, 498, 149, 54, 53/64, 65; 356/445, 448; 250/223

[56] References Cited

U.S. PATENT DOCUMENTS

| | | | |
|---|---|---|---|
| 2,441,628 | 5/1948 | Griffiths et al. . | |
| 4,090,794 | 5/1978 | Benini | 356/445 |
| 4,507,903 | 4/1985 | Focke et al. | 53/149 X |
| 4,528,801 | 7/1985 | Seragnoli et al. | 53/494 |

FOREIGN PATENT DOCUMENTS

| | | | |
|---|---|---|---|
| 1130750 | 5/1962 | Fed. Rep. of Germany . | |
| 2739366 | 5/1981 | Fed. Rep. of Germany . | |
| 2115144 | 9/1983 | United Kingdom | 356/445 |

OTHER PUBLICATIONS

SA/SIB News "Cigarette end detector, solid state type, kit for 3-279/5000 packer" (1982).

*Primary Examiner*—James F. Coan
*Attorney, Agent, or Firm*—Parkhurst & Oliff

[57] ABSTRACT

Three rows of feelers sliding in openings in support plates each bear either a blocking element with a single sight for the outside rows of feelers or a blocking element with two sights for the middle row. When all the feelers are in operative position, the various blocking elements define two parallel sight paths which permit a light beam conveyed to the entry of the first pass through one of the sights of the middle row blocking elements and through all the sights of the blocking elements of one of the outside rows to be reflected from two mirrors, disposed at right angles to each other, and to return by passing through the other sight of the middle row blocking elements and through the sights of the blocking elements of the other outside row. The light beam is conducted from an emitter to the entry of the checking device and from the exit thereof to a sensor by fiber optics cables.

6 Claims, 4 Drawing Sheets

CIGARETTE CHECKING DEVICE AND PACKAGING APPARATUS

Figure 1:
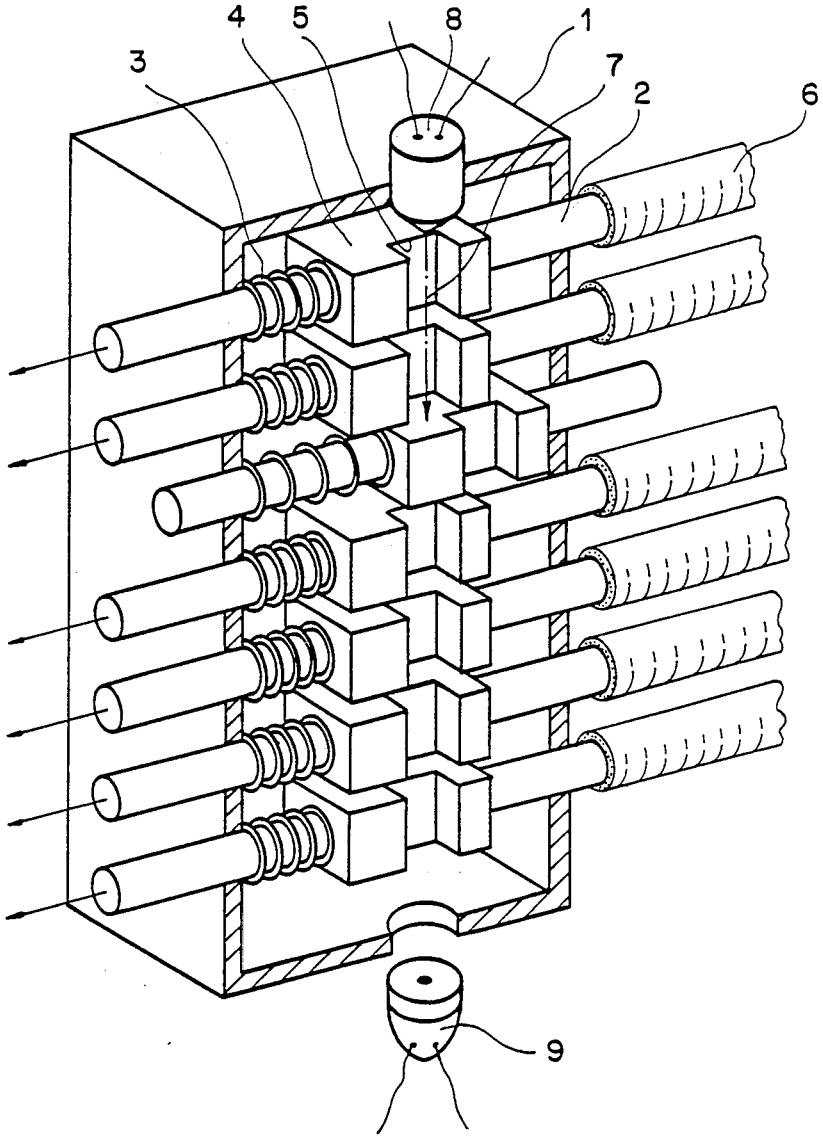
FIG. 1 (PRIOR ART)

This invention relates to cigarette manufacture, and more particularly to a device for checking cigarettes grouped for packaging, of the type having an assembly of elongated feelers movable longitudinally and independently of one another on a support which is brought into a position situated at the ends of the cigarettes, blocking elements integral with the feelers, and one or more emitters and sensors of a light beam arranged in such a way that light beams directed along predetermined paths are intercepted or reach the sensors according to the positions of the blocking elements and thus make possible the detection of an abnormal position of a feeler.

The invention further relates to apparatus for packaging cigarettes, of the type having a compartment wheel, wherein each compartment is designed to receive a group of twenty cigarettes to be packaged.

Machines for packaging cigarettes are equipped with checking devices which go into operation after the formation of groups of twenty cigarettes arranged in three rows, the outer rows each containing seven cigarettes and the inner row six. In these groups, the cigarettes are pressed against one another, and their ends are exposed. When feelers such as mentioned above come in contact with the ends of the cigarettes, if a cigarette is missing or only partially filled with tobacco at the end, the associated feeler undergoes an abnormal displacement which can be detected and in turn used to trigger certain operations such as ejection of the faulty group or any other appropriate operation.

Checking devices in which the feelers are provided with electric contacts have already been proposed. However, this arrangement does not always give satisfaction owing to oxidation of the contacts and the maintenance difficulties inherent in such devices.

Another proposal has been checking devices in which, when the feeler support is situated facing the ends of a group of cigarettes, the positions of the feelers is detected by means of a beam of light such as mentioned above. These light beams are emitted by electronic devices, usually LEDs, and are detected by phototransistors, for example, such electric elements being mounted on the feeler support and powered by electrical connections which likewise transmit the detection signals. West German Patent No. 1,130,750 describes a device of this type.

Furthermore, West German Patent No. 2,739,366 describes a device in which, for the purpose of providing continuous verification of the return of the feelers to their inactive positions, six LEDs and six sensors are disposed along parallel paths on each support, with two paths per row of feelers. This verification is necessary because the packaging machines operate in a highly disruptive environment, in the presence of tobacco dust or even particles of tobacco which may be ejected and may accumulate on the moving parts of the devices in question. It has also been found that, owing to the vibration and the rapid movements to which the various parts of the packaging machine and the checking devices are subjected, the electrical contacts and electronic elements involved have a shortened life.

It is therefore an object of this invention to provide an improved control device which is simpler, more reliable, and less expensive than the prior art devices.

To this end, in the control device according to the present invention, of the type initially mentioned, the emitters and sensors are situated in a fixed position away from the feeler supports, and fiber optics conductors conduct the beam or beams of light between the ends of the paths and the emitters and sensors.

In the apparatus for packaging cigarettes according to this invention, also of the type initially mentioned, two of the aforementioned improved checking devices are associated with the wheel, disposed one on each side thereof, and the light emitters and sensors of the two checking devices are disposed at a central checking station from whence the fiber optics conductors extend to the feeler supports, these supports being movable in a direction parallel to the axis of the wheel in order to bring the feelers into contact with the ends of the cigarettes grouped in the compartments.

Figure 2:
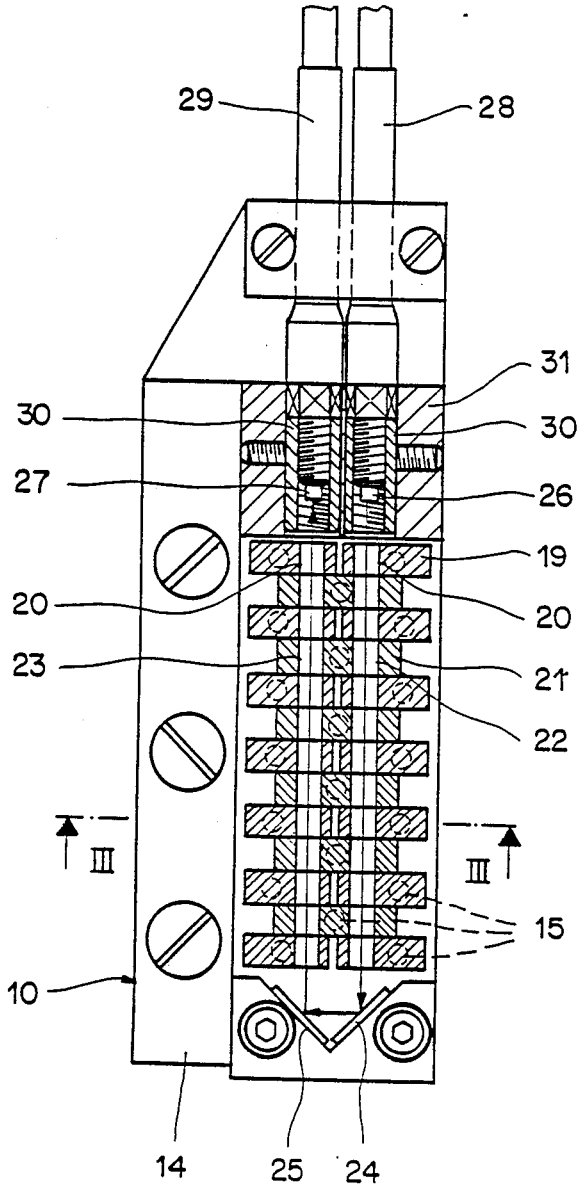
Figure 3:
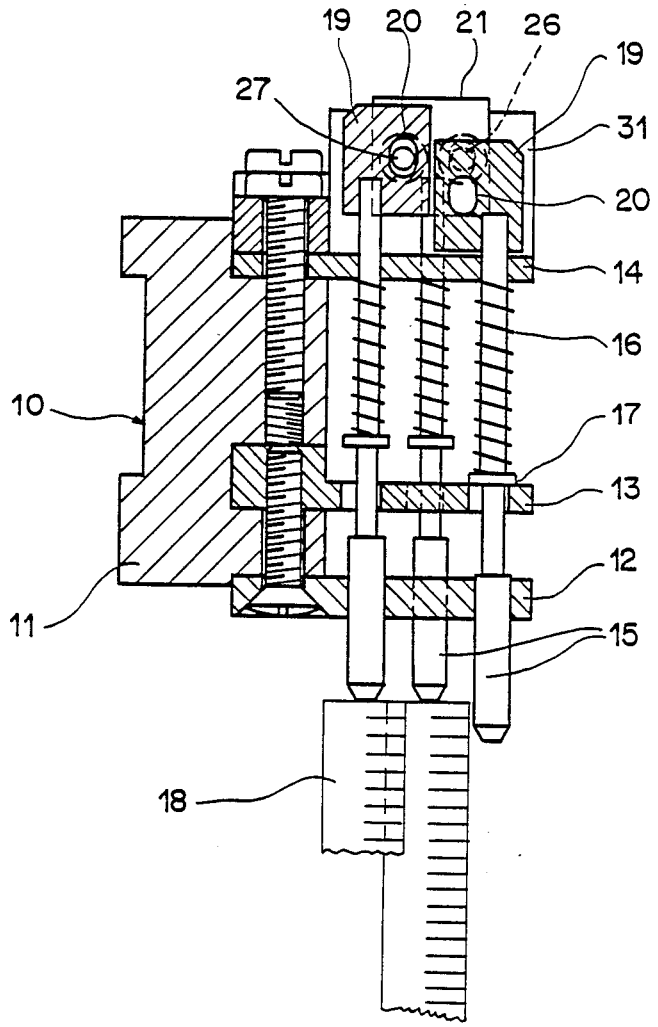
Figure 4:
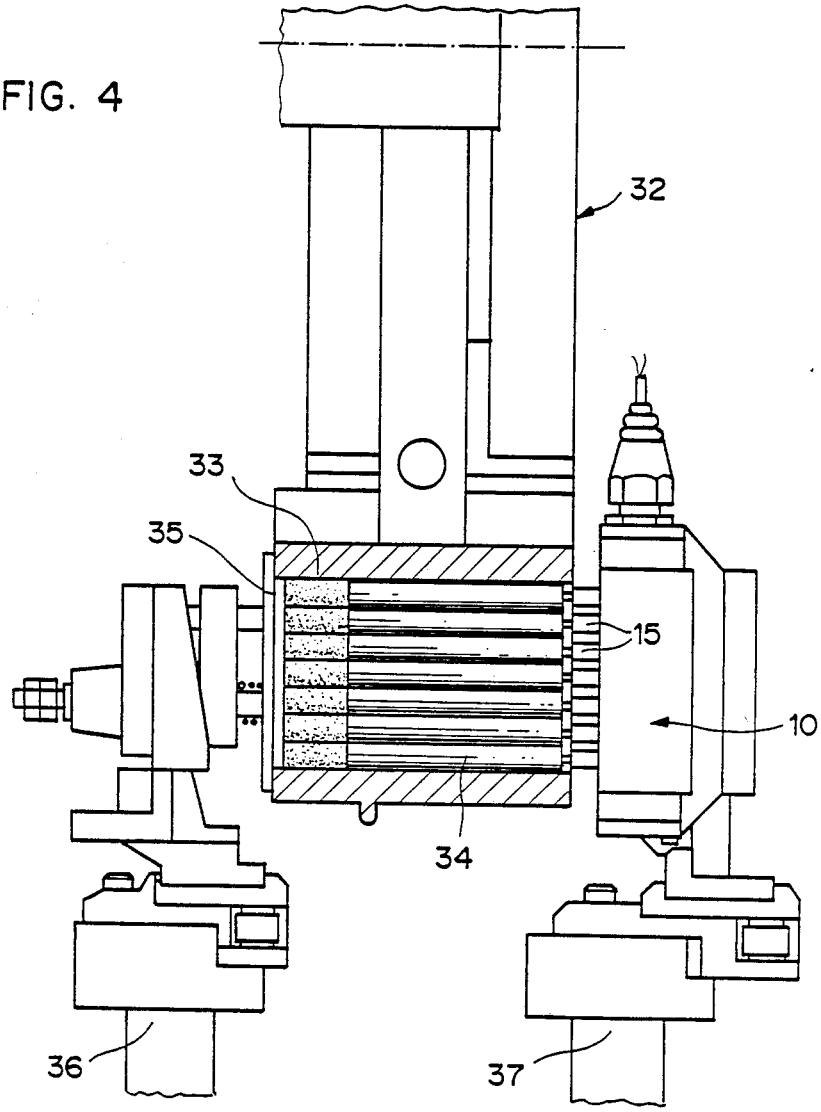

A preferred embodiment of the invention will now be described in detail with reference to the accompanying drawings, in which:

FIG. 1 is a diagrammatic, cutaway perspective view showing the principle of the detection of the feelers on the basis of a prior art design, FIG. 2 is an elevation, partially in section, of a feeler support in an embodiment of the present invention, FIG. 3 is a section, on a larger scale, taken on the line III—III of FIG. 2, and FIG. 4 is a partial view, on a smaller scale, of a compartment wheel.

By way of background, FIG. 1 depicts diagrammatically a prior art checking device operating on the principle of light-beam detection. Mounted on a support 1 are elongated feelers 2 which slide longitudinally against the bias of springs 3. Each feeler 2 is provided with a blocking element 4 having a slot-shaped sight 5. FIG. 1 shows a row of feelers 2 which, when support 1 is brought into checking position, rest against one end of the row of cigarettes 6 and are pressed back against the bias of springs 3 so that sights 5 are in the path of a light beam 7 emitted by an LED 8. This LED is mounted on support 1, at the other end of which there is a light sensor, e.g., a phototransistor 9. If all the sights 5 of the blocking elements 4 are duly aligned in the path of light beam 7, sensor 9 is activated and transmits a control signal. If, on the other hand, one of the feelers 2 is not displaced when support 1 is put in place, say, because one of the cigarettes 6 is missing, the associated blocking element 4 intercepts light beam 7, and sensor 9 is not activated.

A detector of this type has the shortcomings mentioned earlier, whereas the improved device, an embodiment of which is now to be described, has proved to be more reliable in operation. This embodiment is illustrated in FIGS. 2 and 3. A support 10 is seen to comprise a horizontal base 11 and three guide plates 12, 13, and 14, rigidly fixed to base 11. Plates 12-14 guide twenty feelers 15 arranged vertically in three rows, viz., a middle row of six feelers and two lateral rows of seven feelers each. Springs 16 pressing on upper plate 14 and on collars 17 urge feelers 15 forward, the travel of each feeler 15 being limited by collar 17 butting against intermediate plate 13. FIG. 3 shows support 10 in operative position, as well as the positions assumed by the ends of cigarettes 18 assembled in a group in which the cigarettes occupy the same positions relative to one another as in a closed pack. It will be seen that if the cigarettes are at a foreseen location and are correctly filled, feelers 15 are pushed back from their rest position against the bias of springs 16, with collars 17 moving away from side plate 13; whereas if a cigarette is missing, the feeler remains in its inoperative position, as is the case with the right-hand feeler in FIG. 3. Conversely, if a cigarette has not gone all the way into the compartment, the associated feeler is pushed farther back.

Each feeler 15 is provided at its rearward end with a blocking element, but it will be noted that the blocking elements are of two different types depending upon the row to which their associated feeler belongs. Thus, blocking elements 19 associated with the feelers of the two outer rows are narrow and have only a single sight 20, whereas blocking elements 21 associated with the feelers of the middle row include two sights 22 and 23. It wil be seen from FIG. 2 that if all the blocking elements are situated together in operative position, the different sights 20, 22, and 23 bound two straight paths, parallel to the rows, through which a light beam can pass.

It will also be seen from FIG. 2 that two mirrors 24 and 25 are mounted at one end of support 10, placed at right angles to one another and at 45° angles relative to the paths determined by sights 20, 22, and 23 of blocking elements 19 and 21. It will be understood that a light beam emanating from an entry location such as that designated 26 in FIG. 2, and directed along the axis of sights 20 and 22, will pass through the blocking elements until it is reflected by mirror 24, then by mirror 25, and will return through sights 20 and 23 to an exit location 27 situated just beside entry 26. It suffices for one of the twenty feelers 15 to be in a faulty position in order for the light beam to be intercepted, so that with just one emitter and one sensor, the group of cigarettes intended for a pack can be checked at one end.

Moreover, to increase the operating reliability and simplicity of the check even further, the above-mentioned entry and exit means 26 and 27 are constituted by the ends of fiber optics cables 28 and 29. These cable ends are fitted in carefully adjusted sleeves 30 fixed in bores in a block 31 secured to base 11. Thus, the light beams conducted by cables 28 and 29 are correctly aimed at mirrors 24 and 25. At the other ends (not shown) of cables 28 and 29, there are disposed a light-emitter, e.g., an LED, and a sensor, e.g., a phototransistor, respectively. The phototransistor is equipped with an amplifier in order to improve the sensitivity of detection. The light-emitter will preferably be of the infrared type, and the sensitivity of the amplifier associated with the sensor will be adjustable.

FIG. 4 shows part of a compartment wheel 32 of the type generally associated with the cigarette-packaging machine, having compartments 33 designed to receive exactly one group 34 of twenty cigarettes each, arranged as is usual in a pack of cigarettes. These cigarettes are squeezed laterally against one another in the compartment 33, with their ends exposed. During rotation of compartment wheel 32, the different compartments 33 pass through several stations, two of which may be assigned to checking on the presence and completeness of the cigarettes. One of these stations is shown in FIG. 4. In each station there is a brace plate 35 mounted on a support 36 placed opposite the rearward ends of the cigarettes and, at the front, a bracket 37 bearing a support such as 10. Wheel 32 being stopped in such a position, support 10 is moved parallel to the longitudinal axis of feelers 15 so that these may be brought into operative position and a check of one end of the cigarettes carried out. If the group of cigarettes proves faulty, i.e., if the light beam emitted at the entry end 26 of fiber optics cable 28 does not reach the sensor disposed at the other end of cable 29, a signal to eject that group of cigarettes may be given. In the following station, brace plate 35 will be on the side where feeler support 10 was situated in the preceding station, and another feeler support will then be on the opposite side in order to check the other end of the cigarettes. Thus, *it is seen that the device described above may easily be* associated with the compartment wheel of a packaging machine. Furthermore, it is of simple construction and is easy to maintain since the light paths through which the beams pass are defined solely by sights 20, 22, and 23 of the various blocking elements, the plane faces of the latter perpendicular to the directions of the light beams being end to end and sliding against one another. Instead of mirrors 24 and 25, a prism might be used, and the sights might be shaped differently from the oval form illustrated.

What is claimed is:

1. A device for checking cigarettes grouped for packaging, comprising:

a support intended to be positioned at one end of a group of cigarettes;

a plurality of elongated feelers movable longitudinally and independently of one another on said support;

one or more light-beam emitting means and one or more light-beam sensing means, said emitting means and sensing means being situated at a fixed location remote from said support;

a plurality of blocking elements integral with said feelers and including sights capable of forming a path for said light beams;

two fiber optics conductors respectively extending between the ends of said path and said emitting means and sensing means;

said support bears twenty said feelers disposed in parallel rows having a middle row and two lateral rows, said support comprising an inlet and an outlet for the fiber optics conductors, said inlet and said outlet being situated at the same end of the rows, and a reflector situated at the other end of the rows, capable of returning a light beam emanating from the inlet of a first optical conductor by following a path parallel to the rows, along an exit path likewise parallel to the rows, and ending at the outlet of a second optical conductor; and said blocking elements integral with the feelers forming the lateral rows include at least one opening situated either on the entry path or on the exit path of the light beam, while the blocking elements integral with the feelers of the middle row include at least one opening disposed on the path of the entry beam and the other on the path of the exit beam.

2. The device of claim 1, wherein the blocking elements are plates oriented perpendicular to said paths.

3. The device of claim 1, wherein the blocking element plates are disposed end to end and slide against one another upon displacements of the feelers without any intermediate guiding means.

4. A device for checking cigarettes grouped for packaging, comprising:

a support intended to be positioned at one end of a group of cigarettes;

a plurality of elongated feelers movable longitudinally and independently of one another on said support;

one or more light-beam emitting means and one or more light-beam sensing means, said emitting means and sensing means being situated at a fixed location remote from said support;

a plurality of blocking elements integral with said feelers and including sights capable of forming a path for said light beams;

first and second fiber optics conductors extending between the ends of said path and said emitting means and sensing means;

said support bears feelers disposed in parallel rows having a middle row and two lateral rows, said support comprising an inlet and an outlet for the fiber optics conductors, said inlet and said outlet being situated at the same end of the rows, and a reflector situated at the other end of the rows, capable of returning a light beam emanating from the inlet of said first optical conductor by following a path parallel to the rows, along an exit path likewise parallel to the rows, and ending at the outlet of said second optical conductor; and said blocking elements integral with the feelers forming the lateral rows include at least one opening situated either on the entry path or on the exit path of the light beam, while the blocking elements integral with the feelers of the middle row include at least one opening disposed on the path of the entry beam and on the path of the exit beam.

5. Apparatus for packaging cigarettes, of the type having a compartment wheel, each compartment being designed to receive a group of cigarettes to be packaged, wherein the improvement comprises:

checking devices disposed on the wheel and each comprising a support intended to be positioned at one end of the group of cigarettes;

a plurality of elongated feelers movable longitudinally and independently of one another on said support;

one or more light-beam emitting means and one or more light-beam sensing means, said emitting means and sensing means being situated at a fixed location remote from said support;

a plurality of blocking elements integral with said feelers and including sights capable of forming a path for said light beams;

first and second fiber optics conductors extending between the ends of said path and said emitting means and sensing means;

said support bears said feelers disposed in parallel rows having a middle row and two lateral rows, said support comprising an inlet and an outlet for the fiber optics conductors, said inlet and said outlet being situated at the same end of the rows, and a reflector situated at the other end of the rows, capable of returning a light beam emanating from the inlet of said first optical conductor by following a path parallel to the rows, along an exit path likewise parallel to the rows, and ending at the outlet of said second optical conductor;

said blocking elements integral with the feelers forming the lateral rows include at least one opening situated either on the entry path or on the exit path of the light beam, while the blocking elements integral with the feelers of the middle row include at least one opening disposed on the path of the entry beam and on the path of the exit beam;

the light emitters and sensors of the checking devices being disposed at a central checking station from where the fiber optics conductors extend to the feeler supports; and said supports being movable in a direction parallel to the axis of the wheel in order to bring the feelers into contact with the ends of the cigarettes grouped in the compartments.

6. Apparatus for packaging cigarettes, of the type having a compartment wheel, each compartment being designed to receive a group of twenty cigarettes to be packaged, wherein the improvement comprises:

two checking devices disposed one on each side of the wheel and each comprising a support intended to be positioned at one end of the broup of cigarettes;

a plurality of elongated feelers movable longitudinally and independently of one another on said support;

one or more light-beam emitting means and one of more light-beam sensing means, said emitting means and sensing means being situated at a fixed location remote from said support;

a plurality of blocking elements integral with said feelers and including sights capable of forming a path for said light beams;

two fiber optics conductors respectively extending between the ends of said path and said emitting means and sensing means;

said support bears twenty said feelers disposed in parallel rows having a middle row and two lateral rows, said support comprising an inlet and an outlet for the fiber optics conductors, said inlet and said outlet being situated at the same end of the rows, and a reflector situated at the other end of the rows, capable of returning a light beam emanating from the inlet of a first optical conductor by following a path parallel to the rows, along an exit path likewise parallel to the rows, and ending at the outlet of a second optical conductor;

said blocking elements integral with the feelers forming the lateral rows include at least one opening situated either on the entry path or on the exit path of the light beam, while the blocking elements integral with the feelers of the middle row include at least one opening disposed on the path of the entry beam and the other on the path of the exit beam;

the light emitters and sensors of the two checking devices being disposed at a central checking station from where the fiber optics conductors extend to the feeler supports; and said supports being movable in a direction parallel to the axis of the wheel in order to bring the feelers into contact with the ends of the cigarettes grouped in the compartments.

* * * * *